US005097805A

United States Patent [19]

Uesugi et al.

[11] Patent Number: 5,097,805

[45] Date of Patent: Mar. 24, 1992

[54] VALVE DRIVING SYSTEM FOR INTERNAL COMBUSTION ENGINE

[75] Inventors: Tatsuya Uesugi; Noriyuki Iwata; Osamu Sado; Kazuhiko Hashimoto, all of Hiroshima, Japan

[73] Assignee: Mazda Motor Corporation, Japan

[21] Appl. No.: 591,341

[22] Filed: Oct. 1, 1990

[30] Foreign Application Priority Data

Sep. 29, 1989 [JP] Japan ..... 1-115468
Sep. 29, 1989 [JP] Japan ..... 1-256277

[51] Int. Cl.[5] ..... F01M 1/06

[52] U.S. Cl. ..... 123/90.34; 123/90.27; 74/440

[58] Field of Search ..... 123/90.27, 90.31, 308, 123/432; 74/440

[56] References Cited

U.S. PATENT DOCUMENTS

| | | | |
|---|---|---|---|
| 1,968,338 | 7/1934 | Earles et al. | 74/440 |
| 4,519,264 | 5/1985 | Inui | 74/409 |
| 4,572,117 | 2/1986 | Yoshikawa | 123/90.65 |
| 4,674,452 | 6/1987 | Asanomi | 123/90.31 |
| 4,696,201 | 9/1987 | Hattori et al. | 74/467 |
| 4,915,066 | 4/1990 | Koshimoto et al. | 123/90.27 |

FOREIGN PATENT DOCUMENTS

| | | |
|---|---|---|
| 59-117951 | 7/1984 | Japan . |
| 60-78159 | 5/1985 | Japan . |
| 62-78453 | 4/1987 | Japan . |
| 1-80708 | 3/1989 | Japan . |

OTHER PUBLICATIONS

P. Flocon, *Toyota Corolla Multi-soupapes Et Maxi--Choix*, L'Automobile Magazine, No. 496, Oct. 1987, pp. 74–75.

*Primary Examiner*—Noah P. Kamen
*Attorney, Agent, or Firm*—Thompson, Hine and Flory

[57] ABSTRACT

A valve driving device of an engine under the present invention is provided with a cam shaft for exclusive use of intake for driving intake valves and a cam shaft for exclusive use of exhaust for driving exhaust valves. At least either the intake valve or the exhaust valve is pluralized and a transmitting member is trained between the cam shaft with more valves to drive and an engine output shaft. Gears to mesh with each other are provided on said two cam shafts. Under the above composition, only one pulley on the driven side or only one sprocket is required and therefore compactness of the engine can be realized. Also, rotation of the cam shaft having more valves to drive and large torque fluctuation can be stabilized and reliability of gears can be improved, without reinforcing the gears.

8 Claims, 9 Drawing Sheets

FIG. 8
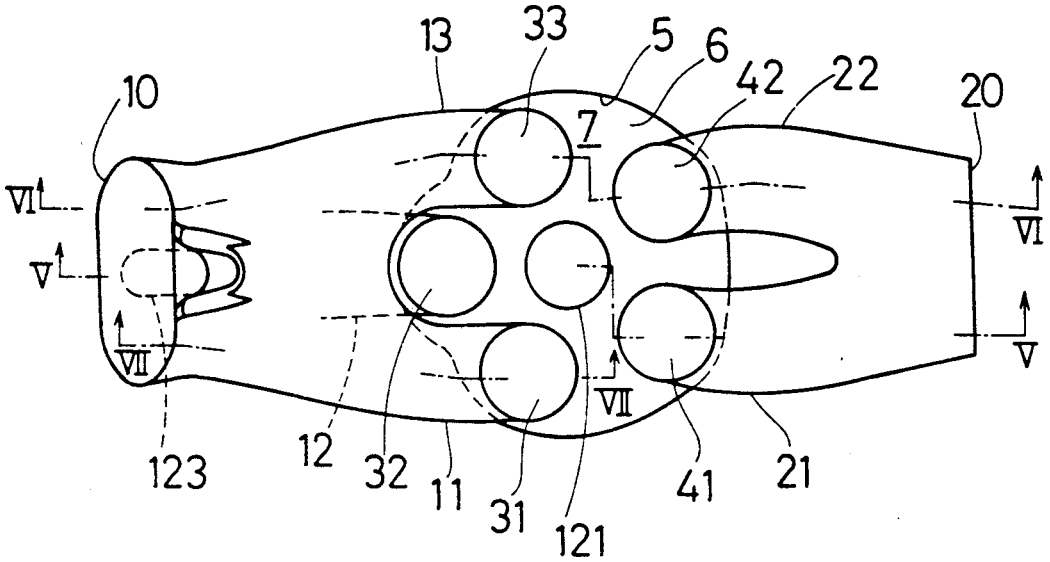
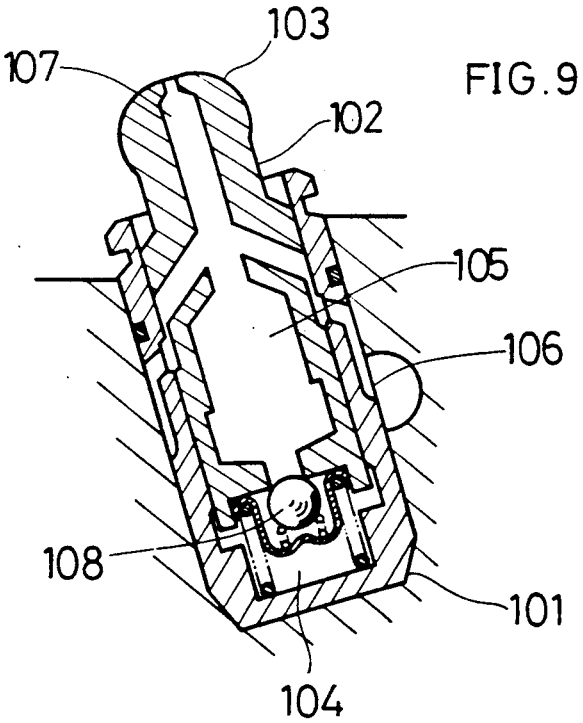
FIG. 9

VALVE DRIVING SYSTEM FOR INTERNAL COMBUSTION ENGINE

BACKGROUND OF THE INVENTION

This invention relates to a valve driving device of an engine provided with a cam shaft for exclusive use of intake and a cam shaft for exclusive use of exhaust.

An engine with multiple valves, such as disclosed by the Japanese Patent Application Laying Open Gazette No. 62-78453, is known. This engine has three intake valves and two exhaust valves for each cylinder so as to obtain high intake and exhaust efficiency. More particularly, in this engine the three intake valves are arranged on one side of the cylinder bore and are angled toward end portions of valve shafts and are parallel to each other, and the two exhaust valves are arranged on the opposite side of the cylinder bore and are angled toward end portions of valve shafts. Thus, the under surfaces of the valve head parts of the intake and exhaust valves forms a combustion chamber of pent roof shape of high combustion efficiency. According to this engine, the intake valves are driven by a cam shaft for exclusive use of intake valves through the medium of a rocker arm and the exhaust valves are driven by a cam shaft for exclusive use of exhaust valves through the medium of a rocker arm. In the case where a cam shaft is driven in such the engine with multiple valves a transmitting member, such as a timing belt or a timing chain, extends between the cam shaft and the engine output shaft so as to transmit the output torque of the engine output shaft to the cam shaft through the medium of the transmitting member.

In the engine with two cam shafts for exclusive use of intake and exhaust, in case of driving the two cam shafts by the engine output shaft through the medium of the transmitting member, a pulley or sprocket on the driving side is fitted to the engine output shaft and a pulley or sprocket on the driven side, having a diameter about twice in relation to the driving pulley or sprocket on each of the two cam shafts, is required. This requires making the engine larger in size.

From the above, it is suggested to drive either one of the two cam shafts by the engine output shaft through the medium of the transmitting member and to provide both cam shafts with gears which mesh with each other so that the cam shaft driven by the transmitting member in turn drives the other cam shaft, thereby limiting the pulley or sprocket on the driven side to one and making the engine compact.

In the engine with multiple valves (plural valves are provided at least as intake valves or exhaust valves), as shown in FIG. 10, fluctuations of torque applied to one cam shaft according to opening and closing of the valve are large and therefore in case where one of the cam shafts is driven by the other cam shaft through the medium of gears, rotation fluctuation occurs on the cam shaft on the driven side due to torque fluctuation (existence of backlash in gears) and service life of gears shortens due to such torque fluctuations. In this case, if the width of teeth is made larger, it results in checking compactness of the engine.

SUMMARY OF THE INVENTION

The present invention has been made in view of the above problems and its object is that in an engine with multiple valves having two cam shafts for exclusive use of intake and exhaust, compactness of engine is increased by driving two cam shafts with combined use of a transmitting member and gears, while driving the cam shafts stably and increasing the reliability of the gears.

Specifically, the present invention valve driving system for an internal combustion engine provided with a cam shaft for exclusive use of intake which drives an intake valve and a cam shaft for exclusive use of exhaust which drives an exhaust valve, at least one of the intake and exhaust valves being pluralized. Furthermore, in the present invention, a transmitting member is connected between one cam shaft which drives more valves than the other cam shaft and the engine output shaft, and gears which mesh with each other are provided for said two cam shafts.

Under the above composition, in the present invention a cam shaft with more valves to drive is driven by the engine output shaft through the medium of a transmitting member and a cam shaft with fewer valves to drive is driven by the above cam shaft through the medium of gears. Therefore, only one pulley or sprocket on the driven side is required and the engine can be made compact. In this case, since the cam shaft with more valves to drive and larger torque fluctuation is not gear-driven but is driven by the engine output shaft through the medium of the transmitting member, rotation of cam shaft is stabilized.

Also, since the cam shaft with fewer valves to drive and smaller torque fluctuation is driven through the medium of gears, it is easy to check the rotation fluctuation of that cam shaft due to backlash of gears, for example, within a tolerance limit. Moreover, small torque fluctuation enables improvement of reliability of gears without a reinforcing measure, such as enlarging of tooth width, and promotes compactness of the engine.

The above object and novel features of the present invention will be understood more clearly by reading the following description, with reference to the accompanying drawings.

BRIEF DESCRIPTION OF THE DRAWINGS

The attached drawings show preferred embodiments of the present invention, in which:

FIG. 8 is a top plan perspective view around a cylinder;

FIG. 9 is a side view, in vertical section, of an oil pressure type lash adjuster, on an enlarged scale.

DETAILED DESCRIPTION OF THE INVENTION

Figure 2:
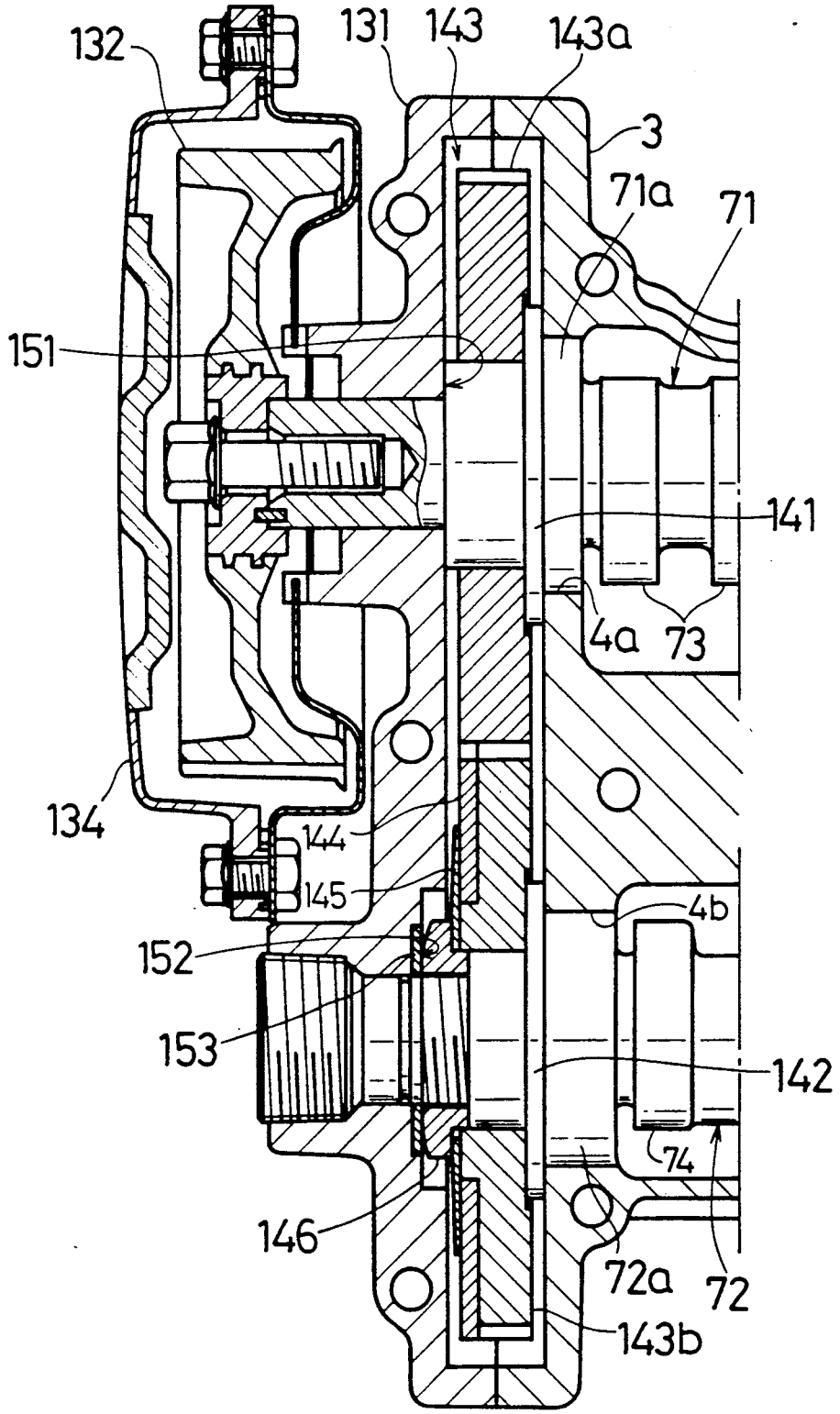
FIG. 2 is a cross sectional view of the front part of the engine, sectioned at the part near the gear between cams.
Figure 3:
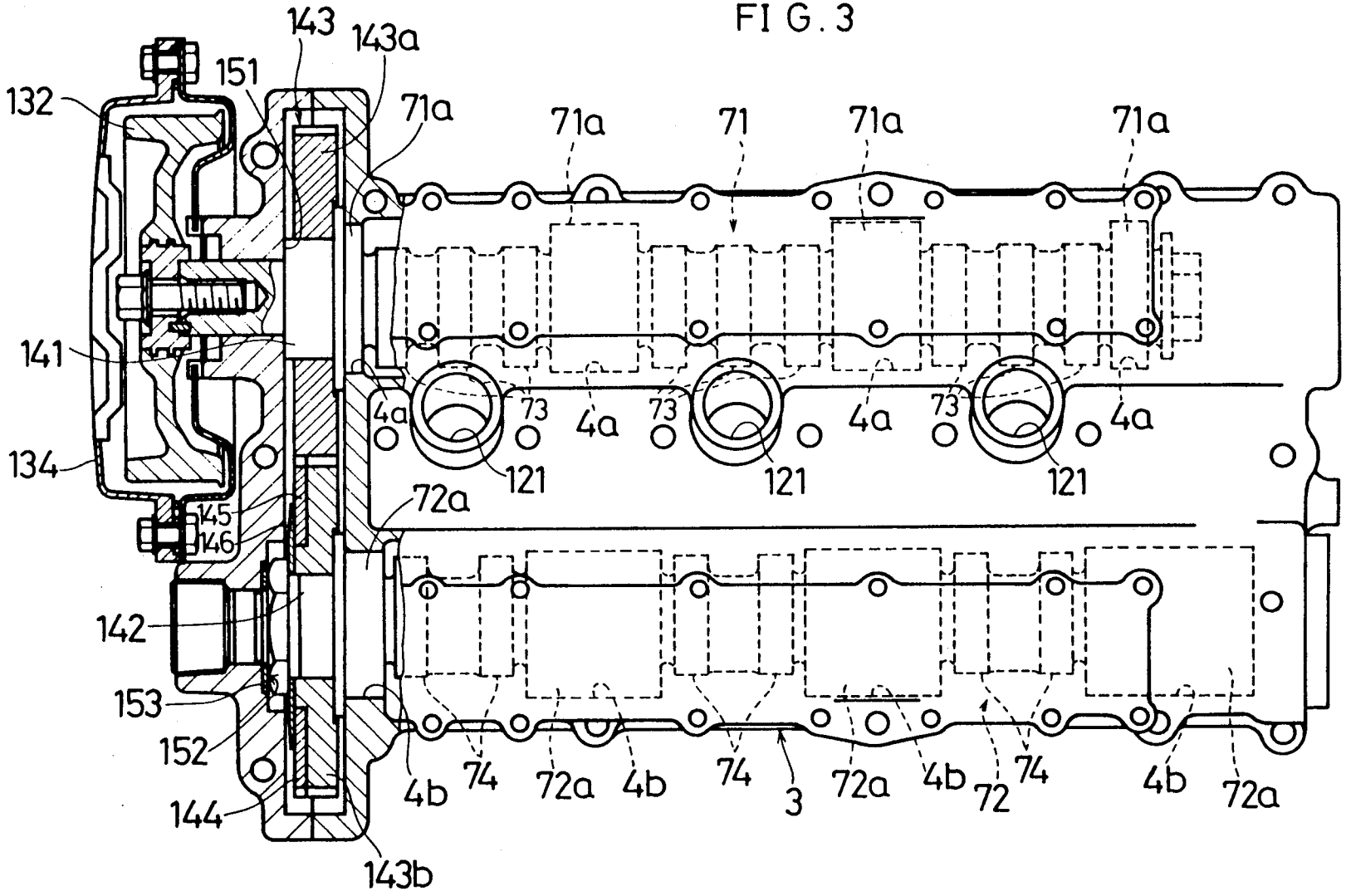
FIG. 3 is a plan view, showing a cam carrier member and a gear housing, partly in section.
Figure 4:
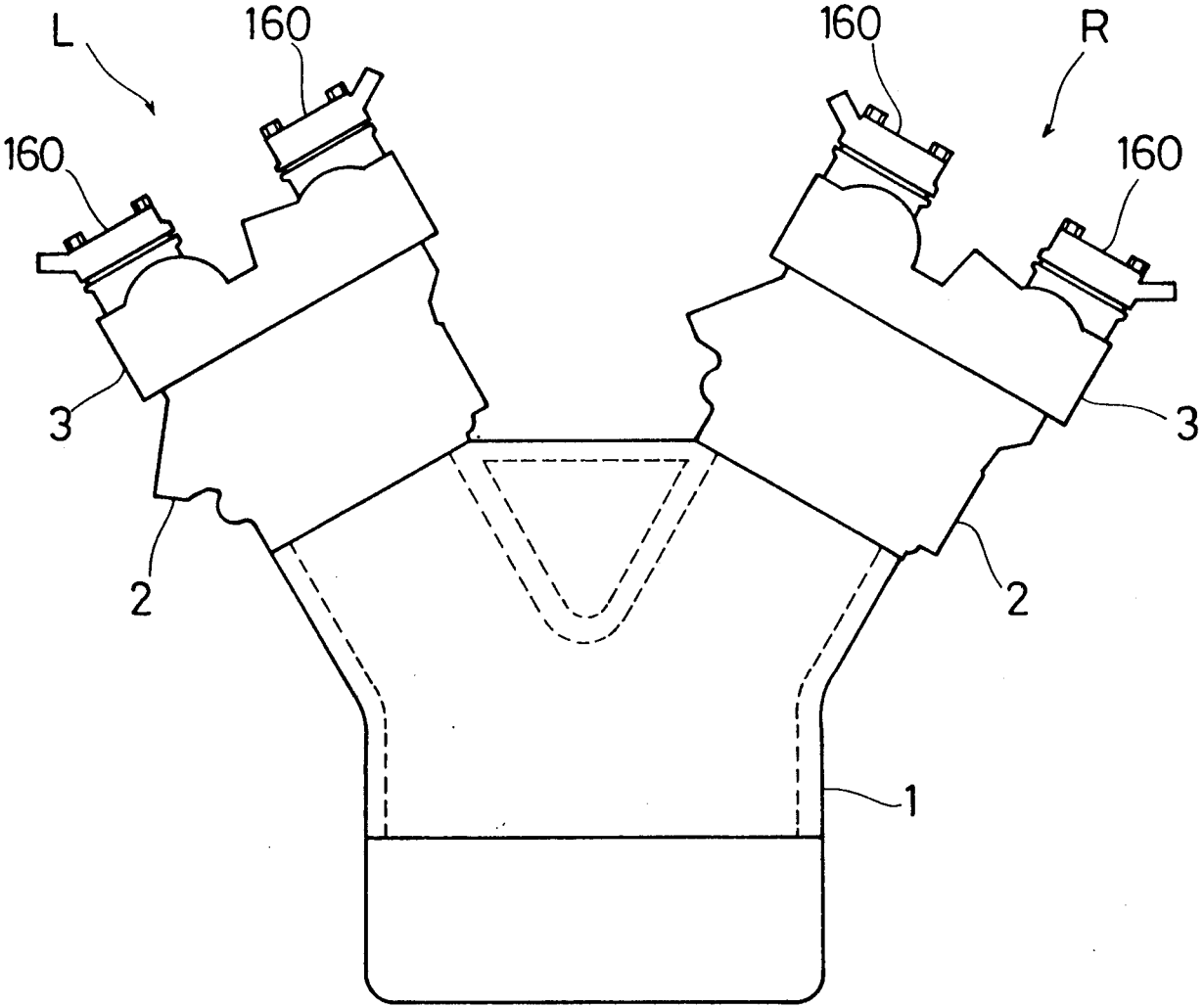
FIG. 4 is a simple elevational view of the engine.
Figure 5:
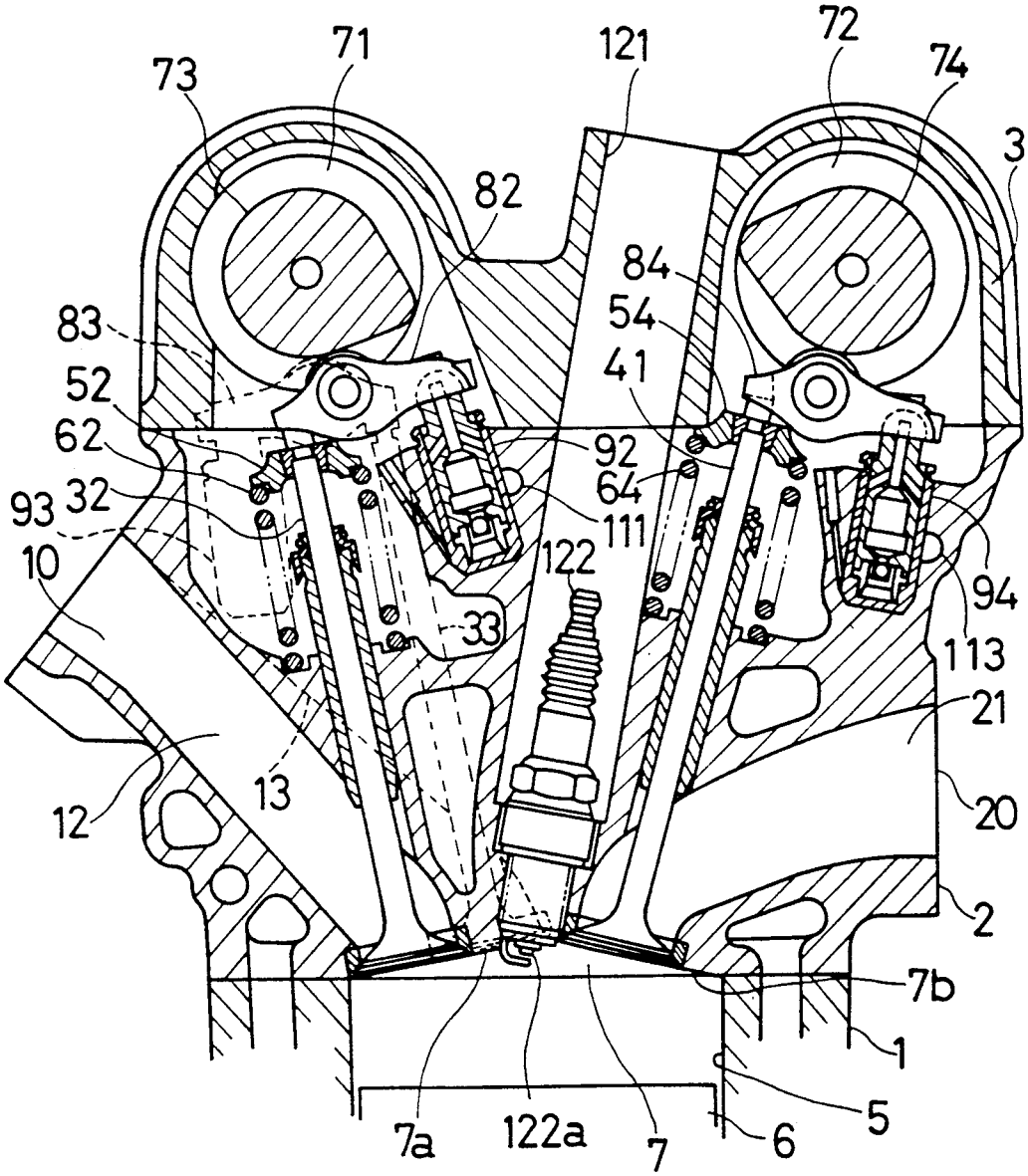
FIG. 5 is a cross section, taken along the line V—V in FIG. 8.
Figure 6:
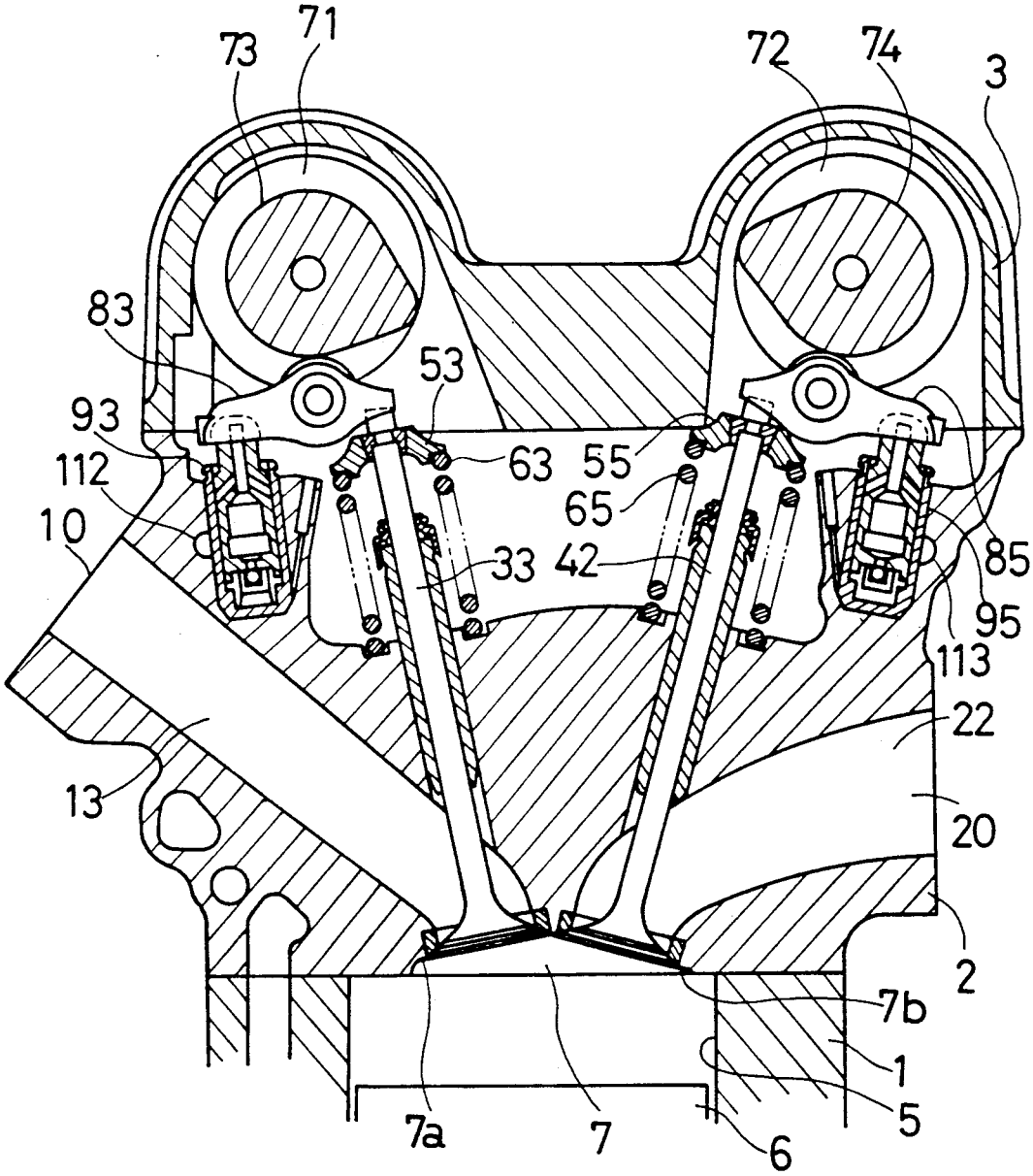
FIG. 6 is a cross section, taken along the line VI—VI in FIG. 8.
Figure 7:
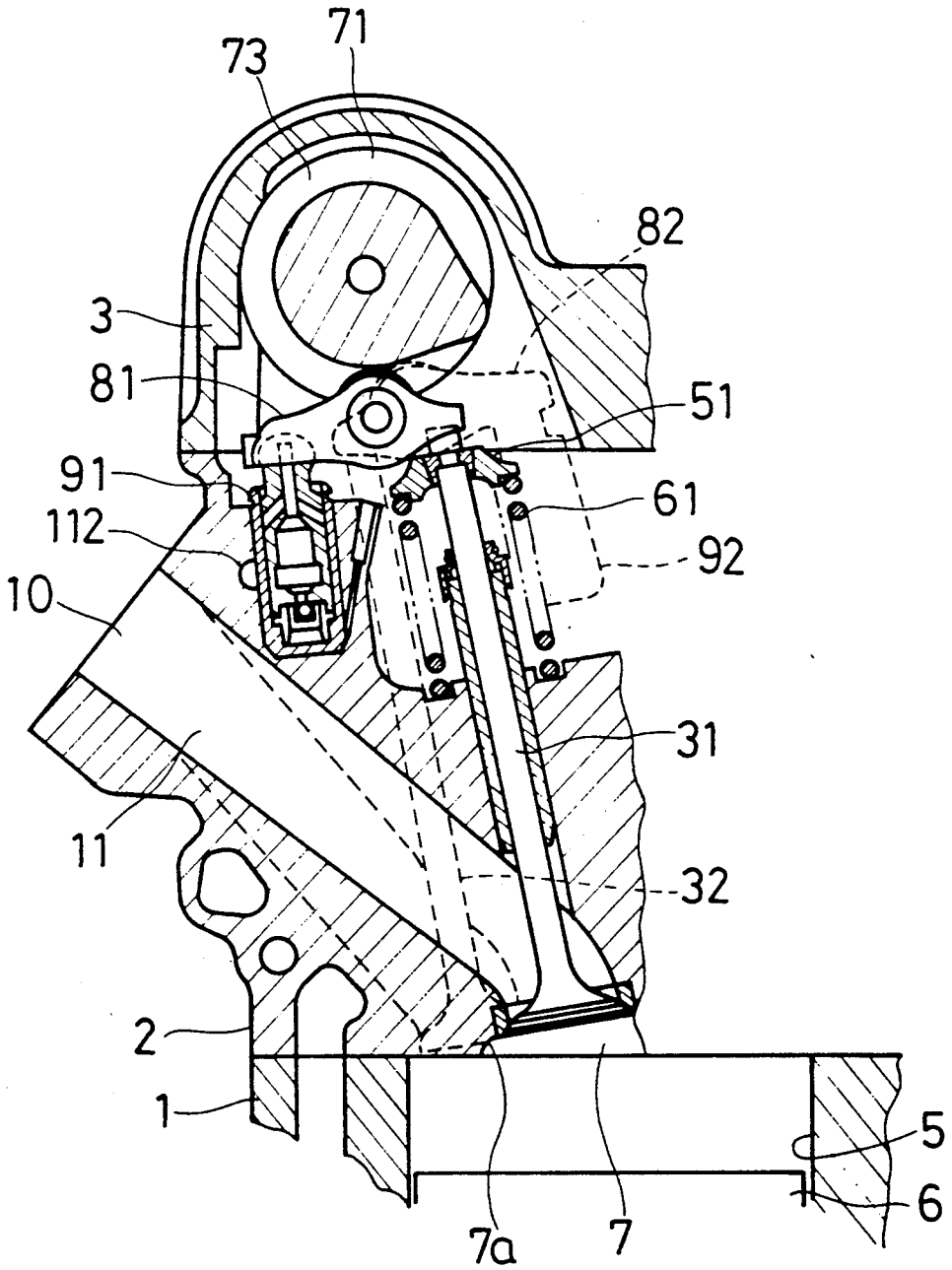
FIG. 7 is a cross section, taken along the line VII—VII in FIG. 8.
Figure 10:
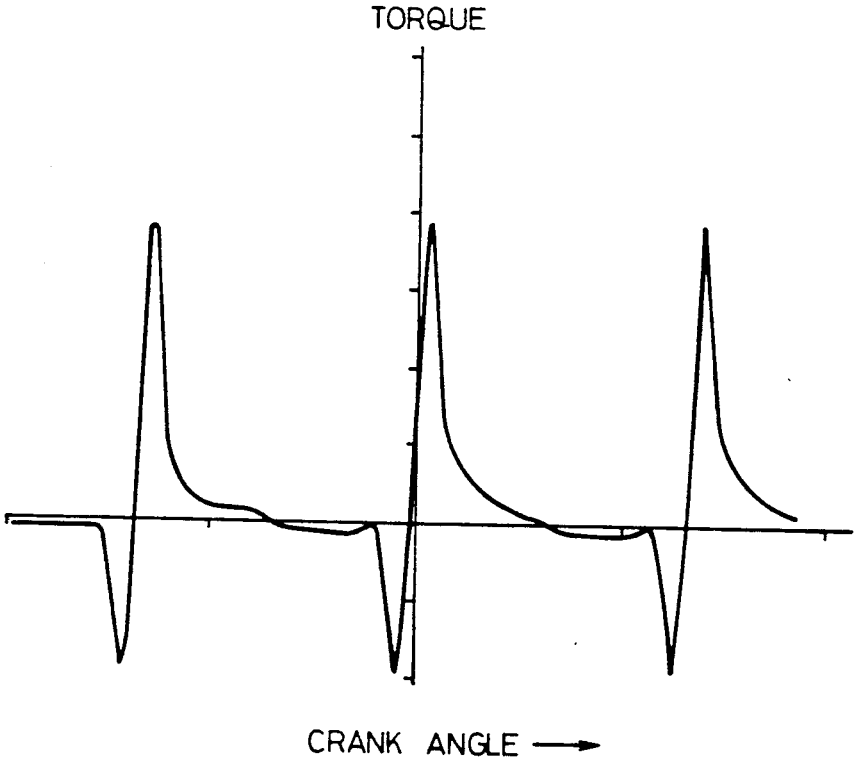
FIG. 10 is an explanatory drawing, showing the fluctuations of torque applied to the cam shaft.

FIG. 1 to FIG. 8 show a V type 6-cylinder engine with three intake valves and two exhaust valves in the embodiment of the present invention. In FIG. 4, reference numeral 1 designates a cylinder block. A cylinder head 2 is provided at each of a left bank L and a right bank R. Three cylinders 5 (FIG. 5) are formed between the cylinder block 1 and each bank L, R. A cam carrier member 3 is provided on the cylinder head 2 of each bank L, R.

Construction around each cylinder 5 is explained with reference to FIG. 5 to FIG. 8. In these figures, only one cylinder 5 of the right bank R is shown as a representative but the other cylinders 5 are all the same in construction. In these figures, a piston 6 is put slidably in the cylinder 5. A combustion chamber 7 of pent roof shape having two inclined walls 7*a*, 7*b* is formed at the cylinder head 2. Three independent intake ports 11, 12, 13 which lead intake to the cylinder 5 are provided at the left side part of a cylinder bore of the cylinder head 2. The independent intake ports 12, 13 open at one end thereof to the inclined wall 7*a* on the left side of the combustion chamber 7 and open at the other end thereof to the left side wall of the cylinder head 2. Openings of the independent intake ports 11, 13 (on both sides) on the combustion chamber side in line in longitudinal direction of the engine (in vertical direction in FIG. 8) and are arranged nearer the center of the cylinder bore than the independent intake port 12 at the center. These three independent intake ports 11, 12, 13 converge into one intake port 10 at the left wall side of the cylinder head 2.

Two independent exhaust ports 21, 22 which lead exhaust of the cylinder 5 outward are provided at the right side part of the cylinder bore of the cylinder head 2. These independent exhaust ports 21, 22 open at one end thereof to the inclined wall 7*b* on the right side of the combustion chamber 7 and open at the other end thereof to the right side wall of the cylinder head. Openings on the combustion chamber side of these two independent exhaust ports 21, 22 form in line in longitudinal direction of the engine. The independent exhaust ports 21, 22 converge into one exhaust port 20.

Three intake valves 31, 32, 33 which open and close the openings on the combustion chamber side of the independent intake ports 11, 12, 13 are provided at the cylinder head 2. Each of the intake valves 31, 32, 33 has a valve head part of umbrella shape arranged at one of the aforementioned port openings and a valve shaft extending upward from the valve head part slidably in the cylinder head 2 at the valve shaft, that is, the valve is movable up and down. Spring sheets 51, 52, 53 of disc shape are fitted to the valve shaft end portions of the intake valves 31, 32, 33 respectively. Valve springs 61, 62, 63 are disposed in compression between the spring sheets 51, 52, 53 and the cylinder head 2. By spring force of the spring sheets 51, 52, 53, each intake valve 31, 32, 33 is biased upward, namely, in valve closing direction.

These three intake valves 31, 32, 33 incline to the left side of the cylinder bore and valve shafts are arranged in parallel with each other.

Two exhaust valves 41, 42 which open and close the openings on the combustion chamber side of the independent exhaust ports 21, 22 are provided at the cylinder head 2. These exhaust valves 41, 42 are similar in composition to the intake valves 31, 32, 33, are movable up and down and are biased in valve closing direction by spring sheets 54, 55 and valve springs 64, 65. These two exhaust valves 41, 42 incline to the right side of the cylinder bore toward the valve shaft end portion.

An explanation is made below about the driving mechanism for the intake valves 31, 32, 33 and the exhaust valves 41, 42.

As shown in FIG. 3, a cam shaft 71 for exclusive use of intake and a cam shaft 72 for exclusive use of exhaust, both extending in longitudinal direction of engine, are arranged on the left side and on the right side of the cylinders 5, respectively. These two cam shafts 71, 72, are driven by an engine output shaft (not shown in the drawing). While the cam shaft 71 for exclusive use of intake rotates clockwise in FIG. 5, the cam shaft 72 for exclusive use of exhaust rotates counterclockwise in FIG. 5. Three intake cams 73 corresponding to each intake valve 31, 32, 33 are formed integrally with the cam shaft 71 for exclusive use of intake and two exhaust cams 74 corresponding to each exhaust valve 41, 42 are formed integrally with the cam shaft 72 for exclusive use of exhaust.

The intake valves 31, 32, 33 are driven by the cam shaft 71 for exclusive use of intake through the medium of swing arms 81, 82, 83 respectively (FIGS. 5–8). Conventional oil pressure type lash adjusters 91, 92, 93 are provided at the cylinder head 2. A support part is provided for each of these oil pressure type lash adjusters 91, 92, 93. The swing arms 81, 82, 83 rest at one end thereof on the support part of the oil pressure type lash adjusters 91, 92, 93 annd rest at the other end thereof on the valve shaft end portion of the intake valves 31, 32, 33. A roller having an axis of rotation in the longitudinal direction of the engine is provided at the halfway part of the swing arms 81, 82, 83 and this roller is in contact with the intake cam 73. Therefore, when the cam shaft 71 for exclusive use of intake rotates, the roller moves up and down according to the lift of the intake cam 73, whereby the swing arms 81, 82, 83 swings up and down with its end portion on the oil pressure type lash adjuster side as center. Thus, the end portion on the valve shaft end portion side of the swings arms 81, 82, 83 swing up and down according to the arm ratio. According to this up and down motion of the end portion, the intake valves 31, 32, 33 open and close.

The exhaust valves 41, 42, 43 are also driven by the cam shaft 72 for exclusive use of exhaust through the medium of the swing arms 84, 85. Similarly to the case of the intake valves 31, 32, 33, this driving mechanism comprises oil pressure type lash adjusters 94, 95 which support the swing arms 84, 85. When the cam shaft 72 for exclusive use of exhaust rotates, the roller of the swing arms 84, 85 moves up and down according to the lift of the exhaust cam 74, whereby the swing arms 84, 85 swing up and down with their end portion on the oil pressure type lash adjuster side as center and the end portion on the valve shaft end portion side of the swing arms 84, 85 swings up and down according to the arm ratio. According to this up and down movement of the end portion, the exhaust valves 41, 42 open and close.

An explanation is made about the construction of the oil type lash adjusters 91, 92, 93, with reference to FIG. 9. In FIG. 9, reference numeral 101 designates a bottomed, cylindrical casing. Reference numeral 102 designates an inner sleeve put slidably in the casing 101. An oil pressure chamber 104 is formed between the casing 101 and the inner sleeve 102. A pivot 103 (as a support part for the end portion of the swing arm 81, 82, 83) is provided at the upper end of the inner sleeve 102. An oil passage 105 which communicates at one end there of with the oil pressure chamber 104 and communicates at the other end thereof with an oil intake 106 provided at the outer wall of the casing, is provided for the casing 101 and the inner sleeve 102. A check valve 108 for keeping oil pressure of the oil pressure chamber 104 high is provided at the end portion on the oil pressure chamber side of the oil passage 105. Provided in the inner sleeve 102 is an oil discharge passage 107 which communicates at one end thereof with the oil passage 105 and opens at the other end thereof to the center of the pivot 103. Referring to the operation of the oil pressure type lash adjusters 91, 92, 93, in the case where a lash exists in the valve driving system and bearing power which the pivot 103 receives form the swing arms 81, 82, 83 is low, oil pressure of the oil pressure chamber 104 is low and therefore the check valve 108 opens. Thus, oil is supplied to the oil pressure chamber 104 from the oil intake 106 via the oil passage 105 and due to cubical expansion of the oil pressure chamber 104, the inner sleeve 102 extends out of the casing 101. By this operation, clearance between the swing arms 81, 82, 83 and the cam shaft 71 for exclusive use of intake and clearance between the swing arms 81, 82, 83 and the intake valves 31, 32, 33 become zero. In this state, bearing power which the pivot 103 receives from the swing arms 81, 82, 83 becomes higher and oil pressure of the oil pressure chamber 104 rises. Thus, the check valve 108 closes. By this operation, the position of the inner sleeve 102 in relation to the casing is fixed and the swing arms 81, 82, 83 are received by the pivot 103.

An explanation is made about the arrangement of the oil pressure type lash adjusters 91, 92, 93, 94, 95. In the case of the intake side, the oil pressure type lash adjuster 92 of the central intake valve 32 is provided near the center of the cylinder bore in relation to the intake valve 31, 32, 33. This oil pressure lash adjuster 92 inclines to the left side by the specified angle toward the pivot 103, namely, it is provided in such a fashion that its center axis conforms to bearing power to be received from the swing arm 82. The oil pressure type lash adjusters 91, 93 of the intake valves 31, 33 on both sides are provided on the side far from the center of the cylinder bore in relation to the intake valves 31, 32, 33, namely, the oil pressure type lash adjusters 91, 92, 93 on the intake side are arranged straddling the intake valves 31, 32, 33 in longitudinal direction of engine. Provided in the cylinder head 2 are an oil supply passage 111 which communicates with the oil intake 106 of the oil pressure lash adjuster 92 of the central intake valve 32 and an oil supply passage 112 which communicates with the oil intake 106 of the oil pressure type lash adjusters 91, 93 of the intake valves 31, 33 on both sides.

In the case of the exhaust side, oil pressure type lash adjusters 94, 95 of the two exhaust valves 41, 42 are provided on the side far from the center of the cylinder bore in relation to the exhaust valves 41, 42. An oil supply passage 113 which communicates with the oil intake 106 of the two oil pressure type lash adjusters 94, 95, is provided in the cylinder head 2.

A plug hole 121 is provided, passing through the cylinder 2 and the cam carrier member 3, above the combustion chamber 7. Fitted in this plug hole 121 is an ignition plug 122 with its ignition point **122*a* facing the combustion chamber 7. The plug hole 121 and the ignition plug 122 are arranged in parallel with the valve shaft of the exhaust valves 41, 42 so that the ignition point 122*a* is located at the center of the cylinder bore of the combustion chamber 7. A single injector 123 which supplies fuel by injection to the intake is provided at the cylinder head 2** at the upper side of the intake port.

Figure 1:
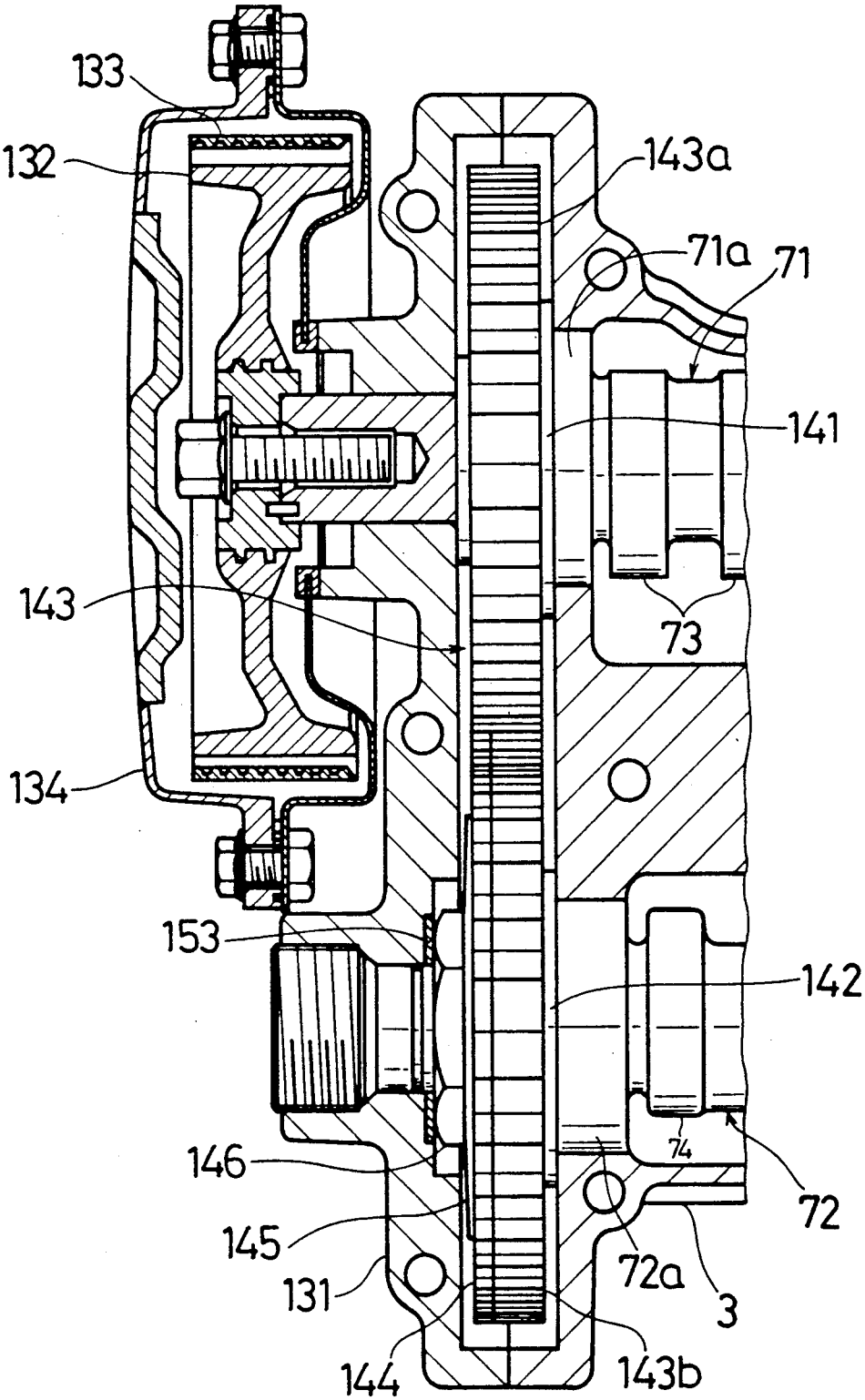
FIG. 1 is a cross sectional view of a front part of the engine.

An explanation is made about the construction for driving the cam shafts 71, 72 by the engine output shaft, with reference to FIG. 1 and FIG. 2. In FIG. 1 and FIG. 2, reference numeral 131 designates a gear housing provided on the front side of the cylinder head 2 (FIG. 4) and the cam carrier member 3. A forward end of the cam shaft 71 for exclusive use of intake extends frontward, passing through the gear housing 131, and is fitted with a timing pulley 132. The engine output shaft is also fitted with a timing pulley (not shown in the drawing). A timing belt 133 (as a transmitting member) is wound round these two timing pulleys and the cam shaft 71 for exclusive use of intake is driven by the specified timing by the engine output shaft through the medium of the timing belt 133. A gear cover 134 which covers the timing pulley 132 is fitted to the gear housing 131.

As shown in FIG. 3, the cam shafts 71, 72 for exclusive use of exhaust are disposed rotatably by bearing, namely, on the left side of the cam carrier member 3, the bearing part **4*b* for exhaust cam shaft is formed at a front end portion, a rear end portion and between cylinders 5. The cam shaft 71 for exclusive use of intake has at its halfway part a bearing collar part 71*a* which is put in and supported by the bearing part 4*a*. The cam shaft 72 for exclusive use of exhaust has at its halfway part a bearing collar part 72*a* which is put in and supported by the bearing part 4*b***.

Inside the gear housing 131, both front end parts of the cam shafts 71, 72 for exclusive use of intake and for exclusive use of exhaust (on the left side in FIG. 1 and FIG. 2) are extended outward from the cam carrier member 3. Fixed to both extensions of the cam shafts 71, 72 for exclusive use of intake and for exclusive use of exhaust respectively are the first and the second flange parts 141, 142 of T-shape. Provided at the outer peripheral surface of the flange part 141 of the cam shaft 71 for exclusive use of intake is a gear system 143 between cams, comprising a driving gear **143*a* which is pressed on to the first flange part 141 of the cam shaft 71 for exclusive use of intake and driven by the engine output shaft (not shown in the drawing) through the medium of the timing pulley 132, and a driven gear 143*b* which is pressed on to the second flange part 142 of the cam shaft 72 for exclusive use of exhaust and meshes with the driving gear 143*a*. For the gear system 143 between cams (driving gear 143*a*, driven gear 143*b*), helical gears which make a slight meshing sound in rotation and have high transmitting capacity are used. An edge front part of the driven gear 143*b* of the cam shaft 72 for exclusive use of exhaust is formed in T-shape (broken in annular shape). A friction gear 144 of annular shape is provided at this broken part to generate friction. A T-shape nut 146 (locking member) for fitting a dish spring 145, which presses elastically the friction gear 144 against the front surface of the broken part of the driven gear 143*b*, to the cam shaft 72 for exclusive use of exhaust is provided forwardly of the driven gear 143*b*. This T-shape nut 146 contacts the front surface of the second flange part 142 and is screwed to the extention of the cam shaft 72 for exclusive use of exhaust. For the friction gear 144, a gear whose number of teeth is one tooth less than the driven gear 143*b* is used. By the specified elastic pressing force (friction) of the friction gear 144 against the front surface of the broken part of the driven gear 143***b*, backlash to be generated at each cam shaft 71, 72 is checked.

Provided at the gear housing 131 is the first contact part 151 which contacts the first flange part 141 when the gear housing 131 is fitted to the front surface of the cam carrier member 3. The front surface of the second flange part 142 of the cam shaft 72 for exclusive use of exhaust contacts the T-shape nut 146, and the second contact part 152 which contacts the front surface of the second flange part 142 through the medium of the T-shape nut 146, when the gear housing 131 is fitted to the front surface of the cam carrier member 3, is provided at the gear housing 131. The second contact part 152 is composed of a plated material 153 (plated steel material).

In FIG. 4, reference numeral 160 designates a cover member fitted to the cam carrier member 3 so that it is located above the cam shaft 72 for exclusive use of intake.

Referring to the case where the cam shaft 71 for exclusive use of intake and the cam shaft 72 for exclusive use of exhaust are positioned in thrust direction in relation to the cam carrier member 3, each cam shaft 71, 72 is inserted from the side without the gear system 143 between cams (namely, from the rear end part) in relation to the front wall surface of the cam carrier member 3 through which the cam shafts 71, 72 can be put so as to have each cam shaft 71, 72 contact the rear surface of the first and the second flange part 141, 142 respectively. Then, the first flange parts 141 of the cam shaft 71 for exclusive use of intake contacts the first contact part 151 of the gear housing 131 and the second flange part 142 of the cam shaft 72 for exclusive use of exhaust contacts the second contact part 152 of the gear housing 131 through the medium of the T-shape nut 146. In this state, the gear housing 131 is fitted to the cam carrier member 3 and the cam shafts 71, 72 are positioned in thrust direction.

The three swing arms 81, 82, 83 are made of the same material and community of parts is planned. In this case, it is suggested to concentrate the centers of rollers of the three swing arms 81, 82, 83 fitted to the engine but this is not done in order to avoid up-sizing the swing arms 81, 82, 83.

In the above embodiment, therefore, the cam shaft 71 for exclusive use of intake is driven by the engine output shaft through the medium of the timing belt and the cam shaft 72 for exclusive use of exhaust is driven by the cam shaft 71 for exclusive use of intake through the medium of the gear system 143 between cams (driving gear 143*a* and driven gear 143*b*). Thus, only one timing pulley 132 on the driven side is required and compactness of the engine is realized. In this case, since the cam shaft 71 for exclusive use of intake having many valves to drive and large torque fluctuation is not gear-driven but is driven by the engine output shaft through the medium of the timing belt 133, rotation of the cam shaft 71 is stabilized.

Also, since the cam shaft 72 for exclusive use of exhaust having less number of valves to drive and small torque fluctuation is driven through the medium of the gear 143 between cams, it is easy to restrict rotation fluctuation of the cam shaft 72 due to backlash of the driven gear 143*b*, for example, within the tolerance limit. Moreover, small torque fluctuation results in improving reliability of the driving gear 143*a* and the driven gear 143*b*, without taking a reinforcing measure (lengthening of width), and compactness of the engine can be promoted.

Furthermore, since the cam shaft 72 for exclusive use of exhaust can be positioned in thrust direction in relation to the cam carrier member 3 by simple composition (the second contact part 152 which contacts the T-shape nut 146 (second flange part 142) with the gear housing 131 is composed of the plated material 153), a thrust plate which is located on the cylinder head side, a bolt which locks the thrust plate to the cylinder head, etc., can be dispensed with. Thus, assembling work including positioning the cam shafts 71, 72 can be done easily.

The present invention is not limited to the above embodiment but includes various modifications, for example, in the above embodiment three intake valves and two exhaust valves are provided but the number of exhaust valves can be increased. In short, the present invention can safely applied to the engine, so far as the engine is provided with a plurality of valves at least as the intake valve or as the exhaust valve.

In the above embodiment, the cam shaft 72 having fewer valves to drive is driven by the belt transmitting mechanism with the timing belt 133 but can be driven by the chain transmitting mechanism with the timing chain.

Furthermore, in the above embodiment the T-shape nut 146 in used as a locking member but conventional nuts and bolts can be used. Also, only the dish spring 145 for pressing the friction gear 144 against the front surface side of the driven gear 143*b* is fitted by the T-shape nut 146 but a T-shape nut for fitting a driven gear (which cannot be fitted to the second flange part by compressing), together with a dish spring, can be used.

Also, in the above embodiment the second contact part 152 of the gear housing 131 is composed of the plated material 153 but any material can be used, so far as it has good wear-resistance and is compatible with the T-shape nut, for the second contact part 152. In the above embodiment, the present invention is stated about the case where it is applied to the V-type engine but is applicable to a vertical type engine.

What is claimed is:

1. A valve driving system for an internal combustion engine having an intake cam shaft exclusively for driving intake valve means and an exhaust cam shaft exclusively for driving exhaust valve means, at least either said intake valve means or said exhaust valve means being pluralized for each cylinder of said engine, there being a difference in number between said intake valve means and said exhaust valve means, and a cylinder head, said system comprising:

transmitting means extending between an output shaft of said engine and one of said cam shafts driving more valve means;

said cam shafts each having an extension including a flange part positioned to protrude through a wall of said cylinder head and mounting a gear thereon, said gears meshing such that said one cam shaft transmits motive power to the other of said cam shafts;

bearing means, mounted on a cylinder head of said engine, for supporting each of said cam shafts;

a gear housing, extending outwardly from said cylinder head, enclosing said gears and having contact parts adjacent to said flange parts;

a friction gear located outwardly of said flange part of said other cam shaft and said gear thereon; and locking means, mounted on said flange part of said other cam shaft, for retaining said friction gear fixed relative to said gear of said other cam shaft, said locking means contacting one of said contact parts.

2. The system of claim 1 wherein each of said cylinders has three intake valves and two exhaust valves comprising said intake and exhaust valve means, respectively, and said transmitting means extends between said intake cam shaft and said engine output shaft.

3. The system of claim 2 wherein said gear of said exhaust cam shaft has said friction gear arranged coaxially on one side surface thereof to generate friction to one side surface of said exhaust cam shaft gear.

4. The system of claim 3 wherein said friction gear has fewer teeth than that of said exhaust cam shaft gear.

5. The system of claim 1 wherein said contact part is made of a plated steel material.

6. The system of claim 1 wherein said locking means is a nut member screwed to said exhaust cam shaft.

7. The system of claim 1 wherein said end portion of said extension of said intake cam shaft has a flange part which contacts one of said contact parts.

8. A valve driving system for an internal combustion engine having a cylinder head provided with bearing means for supporting cam shafts, a first cam shaft extending outwardly from a wall surface of said cylinder head, a gear mounted on an end portion of an extension of said first cam shaft, and a gear housing to cover said gear, said extension end portion side of said first cam shaft being positioned in a thrust direction in relation to said wall surface of the cylinder head, wherein:

said extension part of said cam shaft includes a flange part to contact said outer wall surface of said cylinder head, a friction gear located outwardly of said flange part and arranged coaxially on one side surface of said gear of said cam shaft and a locking member which contacts said flange part and fixes said friction gear to one side surface of said gear, and said gear housing having a contact part to contact said flange part through said locking member.

* * * * *